US010766256B2

(12) United States Patent
Nagamochi et al.

(10) Patent No.: US 10,766,256 B2
(45) Date of Patent: Sep. 8, 2020

(54) LIQUID EJECTION HEAD SUBSTRATE, METHOD OF MANUFACTURING SAME AND LIQUID EJECTION HEAD

(71) Applicant: CANON KABUSHIKI KAISHA, Tokyo (JP)

(72) Inventors: Soichiro Nagamochi, Kawasaki (JP); Yuzuru Ishida, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/369,287

(22) Filed: Mar. 29, 2019

(65) Prior Publication Data

US 2019/0308416 A1 Oct. 10, 2019

(30) Foreign Application Priority Data

Apr. 4, 2018 (JP) ..... 2018-072063

(51) Int. Cl.
*B41J 2/14* (2006.01)
*B41J 2/16* (2006.01)

(52) U.S. Cl.
CPC ..... *B41J 2/14129* (2013.01); *B41J 2/14072* (2013.01); *B41J 2/1601* (2013.01); *B41J 2/1629* (2013.01); *B41J 2/1646* (2013.01)

(58) Field of Classification Search
CPC .. B41J 2/14129; B41J 2/14072; B41J 2/1601; B41J 2/1629; B41J 2/1646
See application file for complete search history.

(56) References Cited

U.S. PATENT DOCUMENTS 5,940,110 A * 8/1999 Nakamura et al. ..... 347/208
8,020,974 B2 * 9/2011 Hara et al. ..... 347/70

FOREIGN PATENT DOCUMENTS

JP 11-42802 A 2/1999

* cited by examiner

*Primary Examiner* — Juanita D Jackson
(74) *Attorney, Agent, or Firm* — Venable LLP

(57) ABSTRACT

Provided is a liquid ejection head substrate having a base, a heat generating resistor layer formed on or above the base and including an electrothermal conversion portion, a wiring electrically connected to the heat generating resistor layer and defining the electrothermal conversion portion and a protecting film covering at least the electrothermal conversion portion and the wiring of the heat generating resistor layer. In the liquid ejection head substrate, the wiring is made of an alloy containing Al as a main component and Cu and having an average crystal grain size of 300 nm or less.

14 Claims, 5 Drawing Sheets

LIQUID EJECTION HEAD SUBSTRATE, METHOD OF MANUFACTURING SAME AND LIQUID EJECTION HEAD

BACKGROUND OF THE INVENTION

Field of the Invention

The present invention relates to a liquid ejection head substrate and a method of manufacturing the same. The invention also relates to a liquid ejection head.

Description of the Related Art

Japanese Patent Application Laid-Open No. H11-42802 discloses a method of manufacturing a thermal head including a first step of forming a heat generating resistor on an insulating substrate, a second step of forming a wiring (wiring electrode) to be electrically connected to the heat generating resistor and a third step of forming a protecting film covering the heat generating resistor and a wiring therearound. The second step is equipped with a step of forming a film for wiring made of a material having an etching rate increasing as separating from the insulating substrate and a step of forming a resist on the film for wiring. The second step is equipped further with a step of forming a wiring by subjecting the film for wiring to single wet etching treatment with one kind of an etchant. The wet etching allows etching to proceed not only in a film thickness direction but also in a surface direction. This method therefore can provide a wiring having, at an electrode peripheral portion thereof, a tapered cross-sectional shape.

Japanese Patent Application Laid-Open No. H11-42802 also discloses that an Al-alloy electrode film obtained by adding Si, Cu, Ti or the like to Al has a minute crystal grain size so that it is etched at an increased etching rate.

SUMMARY OF THE INVENTION

In one aspect of the invention, there is provided a liquid ejection head substrate having a base, a heat generating resistor layer formed on or above the base and including an electrothermal conversion portion, a wiring electrically connected to the heat generating resistor layer and defining the electrothermal conversion portion and a protecting film covering at least the electrothermal conversion portion and the wiring of the heat generating resistor layer, wherein the wiring is made of an alloy containing Al as a main component and Cu and having an average crystal grain size of 300 nm or less.

Further features of the present invention will become apparent from the following description of exemplary embodiments with reference to the attached drawings.

DESCRIPTION OF THE EMBODIMENTS

Figure 2:
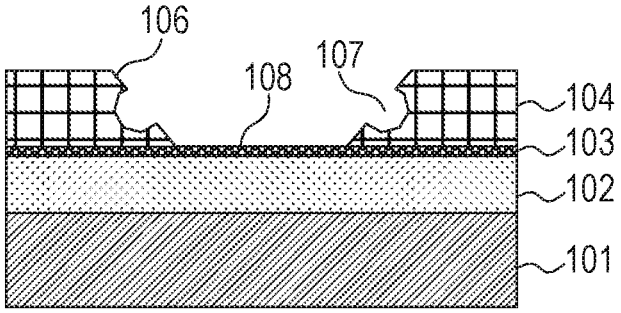
FIG. 2 is a schematic cross-sectional showing a void generated in an etched surface (tapered portion) of a wiring layer of a liquid ejection head substrate.

Addition of Cu to Al used a wiring material of a liquid ejection head is effective for suppressing formation of a hillock during manufacture of a liquid ejection head and is therefore effective for preventing a short-circuit between wirings. When a film for wiring is formed using an alloy containing Al as a main component and Cu and the resulting film for wiring is wet etched and patterned into a wiring, a void sometimes appears in an etched surface of the wiring. FIG. 2 schematically shows this void appearance. A base 101 has thereon an insulating layer 102, a heat generating resistor layer 103 and a wiring 104. A portion of the heat generating resistor layer 103 not having the wiring layer 104 thereon is an electrothermal conversion portion 108. The wiring 104 has, in the wet etched surface (tapered surface) 106 thereof, a void 107.

During formation of the protecting film on the wiring, the protecting film may become thin or have an uneven film quality near the void because it has low void coverage. In particular, since a thick protecting film cannot be formed from the standpoint of thermal conductivity near the electrothermal conversion portion, there is a possibility that a large void in the wiring near the electrothermal conversion portion leads to formation of a liquid ejection head having deteriorated durability. There is therefore a demand for the prevention of appearance of a large void even if wet etching is used for the formation of the wiring.

An object of the invention is to prevent appearance of a void, which will take an adverse effect on the formation of a protecting film, during wet etching for forming a wiring from an alloy containing Al as a main component and Cu and thereby provide a high-durability liquid ejection head substrate, a method of manufacturing the same and a liquid ejection head.

The present invention makes it possible to prevent appearance of a void, which will take an adverse effect on the formation of a protecting film, during wet etching for forming a wiring from an alloy containing Al as a main component and Cu and thereby provide a high-durability liquid ejection head substrate, a method of manufacturing the same and a liquid ejection head.

The invention will hereinafter be described using an ink jet recording head and an ink jet recording head substrate as an example of a liquid ejection head and a liquid ejection head substrate, respectively, but the invention is not limited by them.

[Void Made in Al—Cu Alloy]

Here, a reason why a void appears in an alloy containing Al as a main component and Cu (which may hereinafter be called "Al—Cu alloy") will be described.

A wiring is typically made of a metal film. The metal film has a crystal structure and has, in the structure thereof, crystal grains and grain boundaries. Since Al has a high thermal expansion coefficient, heating during a manufacturing procedure of an ink jet recording head is likely to cause a hillock, that is, a phenomenon showing surface transfer and protrusion of Al. This hillock is causative of a short circuit of the wiring. Addition of Cu to Al is effective for preventing this hillock.

The hillock hardly occurs in such an alloy presumably because Cu atoms present in the crystal grains of Al at the time of deposition of the metal film precipitate at the boundaries of the crystal grains of Al after the film is formed and Cu thus precipitated suppresses transfer of Al.

During precipitation of Cu atoms, those closer to the boundaries of the crystal grains of Al precipitate more. In the vicinity of a portion where Cu was present before precipitation, Cu atoms may be sparse along the grain boundaries after precipitation. When wet etching of the Al—Cu alloy is performed under such a state, an etchant sometimes enters along the crystal grain boundaries where Cu atoms are sparse. It is therefore presumed that due to falling of the crystal grains therefrom, the etched surface has a void. This suggests that with an increase in the crystal grain size, a larger void inevitably appears in the etched surface.

In addition, a void may appear in the etched surface, mainly at the Cu precipitated position thereof, due to an electrochemical reaction between Cu precipitated at the crystal grain boundaries of Al and the crystal grains of Al. With an increase in the crystal grain size of the Al—Cu alloy, the precipitation amount of Cu becomes larger, which may result in a vigorous progress of the electrochemical reaction and inevitable appearance of a larger void in the etched surface.

In the ink jet recording head substrate, the heat generating resistor or wiring is protected by a protecting film to prevent its contact with an ejected ink. An end surface of the wiring, particularly, that adjacent to the electrothermal conversion portion of the heat generating resistor layer can be tapered to form a protecting film with good coverage on a stepped substrate such as wiring. In the wet etching for the formation of such a tapered portion, the phenomenon as described above occurs.

The present inventors have found that a wiring layer made of an Al—Cu alloy having a small crystal grain size can be formed by changing the film forming conditions of the Al—Cu alloy to minimize a void which will appear in the Al—Cu alloy. As a result, they have completed the invention.

Embodiments of the invention will hereinafter be described referring to some drawings.

[Ink Jet Recording Apparatus]

Figure 3:
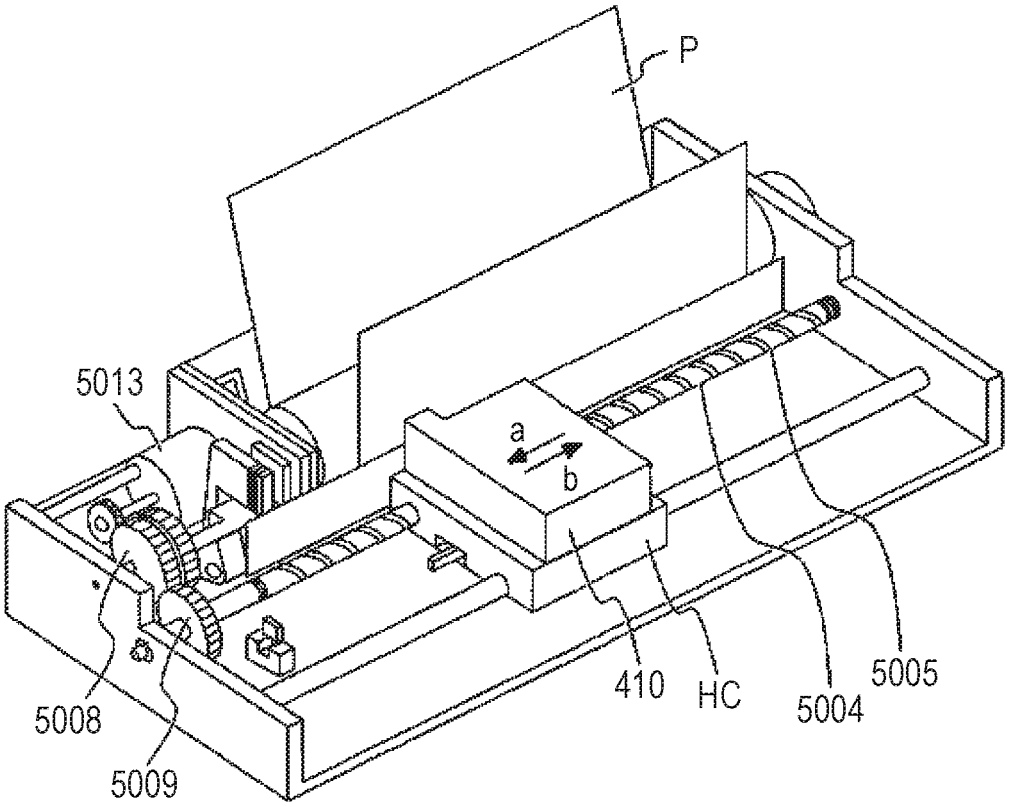
FIG. 3 is a schematic perspective view showing one example of an ink jet recording apparatus.

FIG. 3 shows an ink jet recording apparatus on which an ink jet recording head can be mounted. A lead screw 5004 rotates by means of driving force transmission gears 5008 and 5009, interlocking with the normal/reverse rotation of a driving motor 5013. A carriage HC can have thereon an ink jet head unit (ink jet cartridge) 410. The carriage HC has a pin (not shown) engaging with a helical groove 5005 of the lead screw 5004 and it reciprocates in the arrow directions a and b by the rotation of the lead screw 5004.

[Ink Jet Head Unit]

Figure 4:
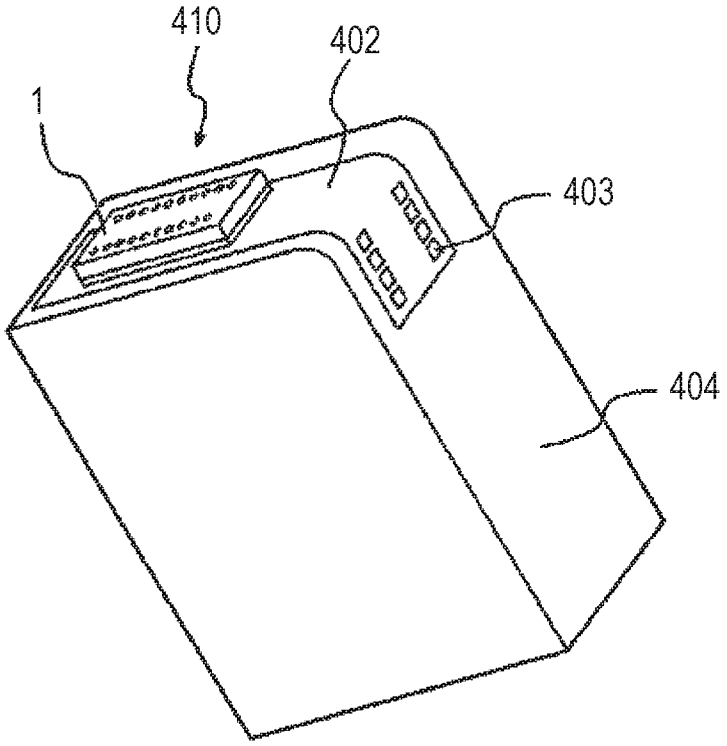
FIG. 4 is a perspective view showing one example of an ink jet cartridge.

FIG. 4 shows one example of an ink jet head unit. The ink jet head unit 410 has an ink jet recording head 1 and an ink storage portion 404 for storing therein an ink to be supplied to the ink jet recording head 1. As one body, they constitute an ink jet cartridge. The ink jet recording head 1 is provided on the surface of the ink jet head unit that faces a recording medium P shown in FIG. 3. They are not necessarily integrated into one body and the ink storage portion 404 may be provided detachably. The ink jet head unit is equipped with a tape member 402 for TAB (Tape Automated Bonding) having a terminal for supplying electric power to the ink jet recording head substrate 1. This tape member 402 enables exchange of electric power or various signals with the main body of the ink jet recording apparatus via a contact 403.

[Ink Jet Recording Head]

Figure 5:
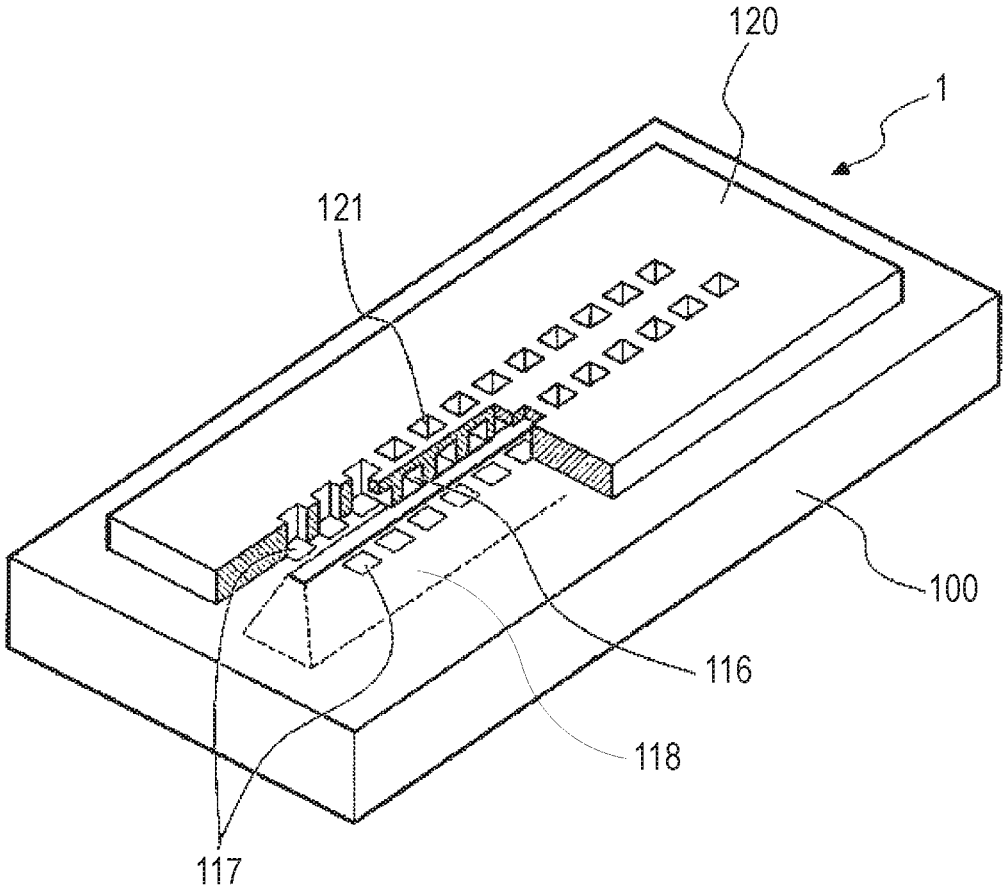
FIG. 5 is a partially broken perspective view schematically showing one example of an ink jet recording head.

FIG. 5 shows the ink jet recording head 1. The ink jet recording head 1 has an ink jet recording head substrate 100 and a flow path forming member 120. The ink jet recording head substrate 100 has thereon a plurality of rows of thermal action portions for applying thermal energy generated by a heat generating resistor to a liquid. The flow path forming member 120 has therein a plurality of rows of ejection orifices 121 for ejecting the liquid and these ejection orifices are arranged to correspond to the thermal action portions 117, respectively. The flow path forming member 120 constitutes an ink flow path 116 extending from an ink supply port 118 penetrating the ink jet recording head substrate 100 to the ink ejection orifices 121 through the thermal action portions 117. From the ink jet recording apparatus, electric power or signals are sent to the ink jet recording head substrate 100 via the tape member 402. This drives the heat generating resistor (electrothermal conversion portion 108) and thermal energy thus generated is applied to the ink via the thermal action portions 117. Then, the ink bubbles and is ejected from the ejection orifices 121.

[Manufacture of Ink Jet Recording Head Substrate]

A manufacturing example of an ink jet recording head substrate will hereinafter be described referring to FIGS. 1A to 1F. These drawings show the vicinity of the thermal action portion of the ink jet recording head substrate to be manufactured.

Figure 1A:
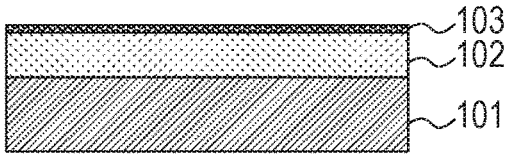
FIG. 1A is a schematic cross-sectional view for describing a method of manufacturing a liquid ejection head substrate according to an embodiment of the invention.

As shown in FIG. 1A, an insulating layer 102 is formed on a base 101 such as silicon substrate. The base 101 may have a switching element such as transistor or wiring in an unillustrated region.

A heat generating resistor layer 103 made of, for example, an alloy such as NiCr, a metal boride such as $ZrB_2$ or a metal nitride such as TaN or TaSiN is formed on the insulating layer 102. At this time, a heat generating resistor layer having a thickness of, for example, from 5 to 50 nm is formed by vacuum deposition, sputtering, or the like.

Figure 1D:
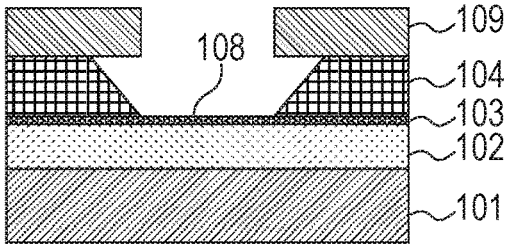
FIG. 1D is a schematic cross-sectional view for describing the method of manufacturing a liquid ejection head substrate according to the embodiment of the invention.

The heat generating resistor layer 103 includes an electrothermal conversion portion 108 (refer to FIG. 1D). The heat generating resistor layer 103 may be a patterned one and therefore, the whole or a portion of the heat generating resistor layer 103 may be the electrothermal conversion portion.

Figure 1B:
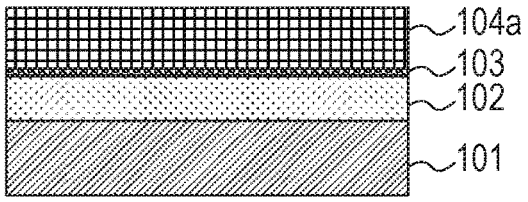
FIG. 1B is a schematic cross-sectional view for describing the method of manufacturing a liquid ejection head substrate according to the embodiment of the invention.

Next, as shown in FIG. 1B, a film 104*a* for wiring made of an Al—Cu alloy and having a thickness of from 500 to 1500 nm is formed on the heat generating resistor layer 103 by CVD or sputtering. The crystal grain size of the film 104*a* for wiring can be adjusted to fall within a range of 300 nm or less by adjusting conditions for forming the film for wiring. The crystal grain size is preferably 50 nm or more from the standpoint of reducing a specific resistance.

With respect to the conditions for forming the film for wiring, for example, by sputtering, a stage temperature can be set at 30° C. or more to 100° C. or less and a DC power per target unit area can be set at 1.2 W/cm$^2$ or more to 12.6 W/cm$^2$ or less.

Figure 1E:
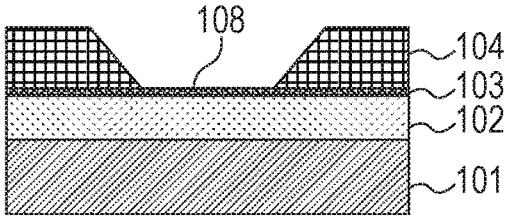
FIG. 1E is a schematic cross-sectional view for describing the method of manufacturing a liquid ejection head substrate according to the embodiment of the invention.
Figure 1C:
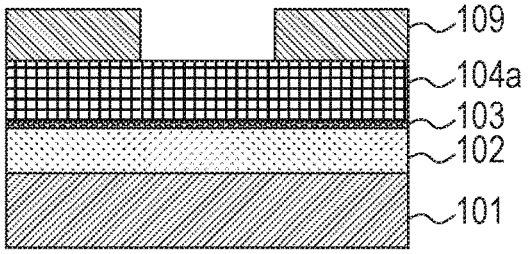
FIG. 1C is a schematic cross-sectional view for describing the method of manufacturing a liquid ejection head substrate according to the embodiment of the invention.

Next, as shown in FIG. 1C, a photoresist is applied to the film for wiring, followed by exposure and development of it through a photomask to form a resist 109 having a wiring shape (pattern).

Next, as shown in FIG. 1D, the film 104*a* for wiring is wet etched with an acid etchant composed of phosphoric acid, acetic acid, nitric acid, pure water and the like to form a wiring 104. A portion of the heat generating resistor layer 103 from which the film 104*a* for wiring has been removed by wet etching becomes an electrothermal conversion portion 108. This means that the wiring 104 defines the electrothermal conversion portion 108 of the heat generating resistor layer 103.

During this wet etching, the etchant enters even the interface between the resist 109 and the film 104*a* for wiring and etching proceeds in both the thickness direction and the surface direction. Upon completion of the etching, therefore, the wiring 104 can have a tapered end surface (etched surface). Due to the above-described adjustment of the crystal grain size, a void formed in the etched surface during wet etching is minute and the wiring 104 can be prevented from having a shape defect. The shape of the etched surface can be observed under a scanning electron microscope.

Next, as shown in FIG. 1E, the resist 109 is removed using a release liquid such as organic solvent.

Figure 1F:
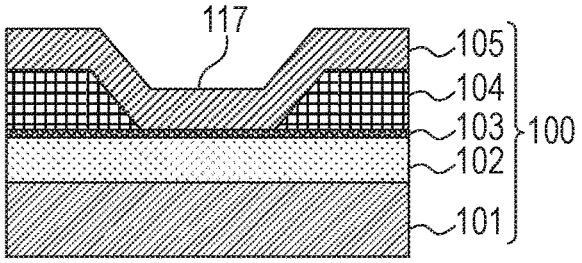
FIG. 1F is a schematic cross-sectional view for describing the method of manufacturing a liquid ejection head substrate according to the embodiment of the invention.

Then, as shown in FIG. 1F, a protecting film 105 made of, for example, SiO or SiN and having a thickness of from 100 to 500 nm is formed by sputtering, CVD or the like. The protecting film 105 is provided to cover the wiring therewith. The protecting film 105 is also provided to cover at least the electrothermal conversion portion 108 of the heat generating resistor layer 103. The protecting film 105 may be provided to cover the whole portion of the heat generating resistor layer 103. The protecting film 105 may also cover the heat generating resistor layer 103 with the wiring 104 therebetween.

An ink jet recording head substrate is obtained in such a manner. Since a void formed in the etched surface (tapered portion) of the wiring 109 is minute, it is possible to form thereon a protecting film having improved step coverage, improve deposition of the protecting film and suppress layer defects such as uneven film quality. This makes it easy to suppress a reduction in the thickness of the protecting film due to an ink under a practical use environment or suppress oxidation caused by application of a potential. As a result, an ink jet recording head substrate having high durability can easily be obtained. A portion of the resulting ink jet recording head substrate located on the electrothermal conversion portion 108 becomes a thermal action portion 117.

An ink jet recording head can be manufactured by forming a flow path forming member on the ink jet recording head substrate by an appropriate method.

The wiring 104 having a tapered end portion (etched surface) is preferred from the standpoint of forming thereon a protecting film 105 having improved step coverage and having a thickness prevented from thinning. In addition, the wiring 104 having a tapered end portion (etched surface) enables the protecting film 105 to have continuity in the surface direction on the end portion of the wiring 104 and enables it to have a uniform film quality. The wiring 104 having a tapered end portion (end surface adjacent to the electrothermal conversion portion 108) is effective for obtaining an ink jet recording head substrate having higher durability.

As the Al—Cu alloy, for example, an alloy containing about 0.5% by mass of Cu and balance Al can be used. The Cu content is, for example, 0.4% by mass or more to less than 0.6% by mass.

The film for wiring has a specific resistance of preferably less than 3.6 μΩ·cm, more preferably 3.1 μΩ·cm or less.

EXAMPLES

The invention will hereinafter be described specifically by Examples, but the invention is not limited by them.

Examples 1A to 1C

Ink jet recording head substrates were manufactured and evaluated in Examples 1A to 1C in the same manner except that sputtering was performed at respectively different stage temperatures.

First, an insulating film 102 having a thickness of 1 μm was formed on a base 101 made of a Si substrate. Next, as shown in FIG. 1A, a heat generating resistor layer 103 made of TaSiN was formed on the insulating film 102 by sputtering. The heat generating resistor layer had a film thickness of 20 nm.

Then, as shown in FIG. 1B, in order to form a wiring for supplying electric power to an electrothermal conversion portion 108 of the heat generating resistor layer, a film 104*a* for wiring having a thickness of 1000 nm was formed by sputtering while using an Al—Cu alloy obtained by adding 0.5% by mass of Cu to Al.

The sputtering was performed in an Ar gas atmosphere at a stage temperature set as shown in Table 1. In Examples 1A to 1C, sputtering was performed at the same DC power (per target unit area) as shown in Table 1.

The surface of the film 104*a* for wiring thus formed was observed under a scanning electron microscope and the crystal grain size of the film for wiring was evaluated. The results are shown in Table 1. The grain size was calculated from a circle into which the image of a grain was converted. At the time of calculation, five crystal grains were observed and their circle-equivalent diameters thus obtained were averaged. It is presumed that the crystal grain size becomes larger with a rise in the stage temperature presumably because the rise in temperature enhances crystal growth.

In addition, the specific resistance of the film for wiring was measured and the film was evaluated based on the following evaluation criteria. In the measurement, the specific resistance was determined from a film thickness measured by X-ray reflectometry and a sheet resistance measured by a resistance meter (Table 1).

A: specific resistance of 3.1 μΩ·cm or less.

B: specific resistance of more than 3.1 μΩ·cm to less than 3.6 μΩ·cm.

It was confirmed that the specific resistance in Example 1C was a little larger than that in Examples 1A and 1B. Such a slight increase in the specific resistance occurred presumably because a decrease in the crystal grain size causes an increase in the area of crystal grain boundaries, facilitating collision of electrons with the grain boundaries.

Next, as shown in FIG. 1C, a photoresist was applied, followed by exposure and development through a photomask to form a resist 109 having a wiring shape.

Next, as shown in FIG. 1D, the film for wiring was wet etched with an acid etchant composed of phosphoric acid, acetic acid, nitric acid, pure water and the like to form a wiring 104. Next, as shown in FIG. 1E, the resist 109 was removed using a release liquid such as organic solvent.

Then, as a result of observation of the surface of the wiring 104 under a scanning electron microscope, it was confirmed that the wiring 104 adjacent to the electrothermal conversion portion 108 had a tapered end surface in each Example. This occurs because the etchant entering the interface between the resist 109 and the film 104*a* for wiring allows etching to proceed in both the thickness direction and the surface direction.

At the same time, it was confirmed that the tapered surface (etched surface) of the Al—Cu alloy had a void therein. Further, it was found that the larger the crystal grain size of the Al—Cu alloy, the larger the void became.

In order to evaluate the shape defect of the tapered surface due to the void, the size of the void was evaluated based on the following criteria. The results are shown in Table 1.

Large: a void size of more than 300 nm.

Medium: a void size of more than 100 nm to 300 nm or less.

Small: a void size of 100 nm or less.

A decrease in the crystal grain size slightly increased the etching rate but was not at the level where it affected the size accuracy or etching time.

Then, as shown in FIG. 1F, a SiN film having a thickness of 350 nm was formed as a protecting film by plasma CVD. By the above-described steps, an ink jet recording head substrate 100 was manufactured.

The ink jet recording head substrate 100 was driven under the following conditions and was evaluated by an ejection durability test.

Drive frequency: 10 kHz, drive pulse width: 1 μsec.

Drive voltage: 1.3 times the voltage at which an ink bubbles.

Here, the evaluation by an ejection durability test was made based on the following criteria:

A: it has durability of $6.0\times10^7$ pulse or more.

B: Rupture of a heat generating resistor layer occurs at $4.0\times10^7$ pulses or more to less than $6.0\times10^7$ pulses.

C: Rupture of a heat generating resistor layer occurs at less than $4.0\times10^7$ pulses.

Comparative Example 1

In a manner similar to that of Example 1A except that the stage temperature was changed to 150° C., an ink jet recording head substrate was manufactured and evaluated. The crystal grain size of the wiring 104 became 500 nm, the minimum size described in Japanese Patent Application Laid-Open No. H11-42802. Also in the present example, the wiring 104 adjacent to the electrothermal conversion portion 108 had a tapered end surface.

TABLE 1

| | Stage temperature during sputtering (° C.) | DC power during sputtering (W/cm$^2$) | Crystal grain size (nm) | Specific resistance | Size of void | Result of ejection durability test |
|---|---|---|---|---|---|---|
| Comp. Ex. 1 | 150 | 25.1 | 500 | — | Large | C |
| Example 1A | 100 | | 300 | A | Medium | B |
| Example 1B | 30 | | 100 | A | Small | A |
| Example 1C | 0 | | 50 | B | Small | A |

Examples 2A to 2C

In a manner similar to that of Comparative Example 1 except that the DC power (per target unit area) during sputtering was changed as shown in Table 2, an ink jet recording head substrate was manufactured and evaluated. Conditions and results of these examples are listed collectively in Table 2. Also in these examples, the wiring 104 adjacent to the electrothermal conversion portion 108 had a tapered end surface.

The crystal grain size becomes larger with an increase in DC power presumably because the increase in DC power elevates the substrate temperature and enhances crystal growth.

TABLE 2

| | Stage temperature during sputtering (° C.) | DC power during sputtering (W/cm$^2$) | Crystal grain size (nm) | Specific resistance | Size of void | Result of ejection durability test |
|---|---|---|---|---|---|---|
| Comp. Ex. 1 | 150 | 25.1 | 500 | — | Large | C |
| Example 2A | | 12.6 | 300 | A | Medium | B |
| Example 2B | | 3.1 | 100 | A | Small | A |
| Example 2C | | 1.2 | 50 | B | Small | A |

The results shown in Tables 1 and 2 have revealed that the ink jet recording head substrates obtained in Examples 1A to 1C and 2A to 2C have sufficient durability. The ejection durability test results have shown that the alloy of the wiring 104 has a crystal grain size of preferably 300 nm or less, more preferably 100 nm or less.

It is presumed that in Comparative Example 1, since the crystal grain size is as large as 500 nm, a void appears in the tapered portion during wet etching of a wiring and the protecting film formed on the wiring has deteriorated step coverage. It is therefore presumed that the protecting film formed near the void is thin and at the same time, has an uneven film quality. The ink jet recording head is exposed to an ink or receives a potential during operation so that oxidation or film loss of the protecting film is presumed to occur at such a portion, finally leading to rupture of the heat generating resistor.

In Examples 1A to 1C and also Examples 2A to 2C, on the other hand, it is presumed that since the void in the tapered portion becomes smaller with a decrease in the crystal grain size, the protecting film has a sufficient thickness due to improved deposition and has an improved film quality.

Thus, in Examples, an increase in the size of a void made in the end surface (etched surface) of the wiring 104 is suppressed. This facilitates formation of a desirable protecting film on the wiring. An ink jet recording head having high durability can therefore be obtained easily.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-072063, filed Apr. 4, 2018, which is hereby incorporated by reference herein in its entirety.

What is claimed is:

1. A liquid ejection head substrate comprising:

a base;

a heat generating resistor layer formed on or above the base and including an electrothermal conversion portion for generating heat and bubbling the liquid for ejection;

a wiring electrically connected to the heat generating resistor layer and defining the electrothermal conversion portion; and a protecting film covering at least the electrothermal conversion portion and the wiring of the heat generating resistor layer, wherein the wiring has an alloy containing Al as a main component and Cu and having an average crystal grain size of 300 nm or less.

2. The liquid ejection head substrate according to claim 1, wherein the average crystal grain size is 50 nm or more.

3. The liquid ejection head substrate according to claim 1, wherein an end surface of the wiring adjacent to the electrothermal conversion portion is tapered.

4. The liquid ejection head substrate according to claim 1, wherein the average crystal grain size is 100 nm or less.

5. A method of manufacturing a liquid ejection head substrate comprising:

a step of forming a heat generating resistor layer including an electrothermal conversion portion for generating heat and bubbling the liquid for ejection on or above a base;

a step of forming a wiring to be electrically connected to the heat generating resistor layer and defining the electrothermal conversion portion; and a step of forming a protecting film covering at least the electrothermal conversion portion and the wiring of the heat generating resistor layer, wherein the step of forming a wiring comprises:

a step of forming a film for wiring having an alloy containing Al as a main component and Cu and having an average crystal grain size of 300 nm or less; and a step of wet etching the film for wiring into the wiring.

6. The method of manufacturing the liquid ejection head substrate according to claim 5, wherein the average crystal grain size is 50 nm or more.

7. The method of manufacturing the liquid ejection head substrate according to claim 5, wherein in the film forming step, the film for wiring is formed by sputtering and in the sputtering, a stage temperature is set at 100° C. or less.

8. The method of manufacturing the liquid ejection head substrate according to claim 7, wherein the stage temperature is set at 30° C. or more.

9. The method of manufacturing the liquid ejection head substrate according to claim 5, wherein in the film forming step, the film for wiring is formed by sputtering and in the sputtering, a DC power per target unit area is set at 12.6 $W/cm^2$ or less.

10. The method of manufacturing the liquid ejection head substrate according to claim 9, wherein the DC power per target unit area is set at 1.2 $W/cm^2$ or more.

11. A liquid ejection head comprising:

a liquid ejection head substrate having a base, a heat generating resistor layer formed on or above the base and including an electrothermal conversion portion for generating heat and bubbling the liquid for ejection, a wiring electrically connected to the heat generating resistor layer and defining the electrothermal conversion portion, and a protecting film covering at least the electrothermal conversion portion and the wiring of the heat generating resistor layer; and a member having therein an ejection orifice for ejecting a liquid, wherein the wiring has an alloy containing Al as a main component and Cu and having an average crystal grain size of 300 nm or less.

12. The liquid ejection head according to claim 11, wherein the average crystal grain size is 50 nm or more.

13. The liquid ejection head according to claim 11, wherein an end surface of the wiring adjacent to the electrothermal conversion portion is tapered.

14. The liquid ejection head according to claim 11, wherein the average crystal grain size is 100 nm or less.

* * * * *